US006916361B2

(12) United States Patent
Jackson et al.

(10) Patent No.: US 6,916,361 B2
(45) Date of Patent: Jul. 12, 2005

(54) METHOD FOR SEPARATION OF NON-HYDROCARBON GASES FROM HYDROCARBON GASES

(75) Inventors: Alan Jackson, Alfred Cove (AU); Robert Amin, Salter Point (AU)

(73) Assignee: Metasource Pty, Ltd., Perth (AU)

( * ) Notice: Subject to any disclaimer, the term of this patent is extended or adjusted under 35 U.S.C. 154(b) by 70 days.

(21) Appl. No.: 10/450,972

(22) PCT Filed: Dec. 19, 2001

(86) PCT No.: PCT/AU01/01637

§ 371 (c)(1),
(2), (4) Date: Oct. 2, 2003

(87) PCT Pub. No.: WO02/50218

PCT Pub. Date: Jun. 27, 2002

(65) Prior Publication Data

US 2004/0074389 A1 Apr. 22, 2004

(30) Foreign Application Priority Data

Dec. 19, 2000 (AU) ..... PR2167

(51) Int. Cl.[7] ..... C10L 3/10; B01D 53/14

(52) U.S. Cl. ..... 95/154; 95/237; 585/15; 585/833

(58) Field of Search ..... 95/149, 154, 237; 62/618, 632; 585/15, 800, 833, 864

(56) References Cited

U.S. PATENT DOCUMENTS 3,505,211 A * 4/1970 Gebhart, Jr. et al. ..... 585/15
5,434,330 A * 7/1995 Hnatow et al. ..... 585/864
6,028,234 A * 2/2000 Heinemann et al. ..... 585/15
6,235,091 B1 * 5/2001 Spencer ..... 96/242
6,602,326 B2 * 8/2003 Lee et al. ..... 95/153
6,733,573 B2 * 5/2004 Lyon ..... 95/153

FOREIGN PATENT DOCUMENTS

| | | | |
|---|---|---|---|
| EP | 0362023 B1 | | 4/1990 |
| EP | 0896123 A1 | | 2/1999 |
| WO | WO 97/09271 | * | 3/1997 |

OTHER PUBLICATIONS

Derwent Accession #2001–445173/48, Mar. 21, 2001.

* cited by examiner

*Primary Examiner*—Frank M. Lawrence
(74) *Attorney, Agent, or Firm*—Edell, Shapiro & Finnan LLC

(57) ABSTRACT

A method for the separation of non-hydrocarbon gases from hydrocarbon gases, the method comprising the steps of: adding water and an agent adapted to reduce the interfacial tension between water and hydrocarbons to a first stream of desired hydrocarbon and undesired non-hydrocarbon gases to form a gas-agent-water mixture; pressurising the gas-agent-water mixture; and cooling the gas-water-agent mixture to initiate the formation of a hydrate richer in desired hydrocarbons and leaner in undesired non-hydrocarbons relative to the first stream of desired hydrocarbon and undesired non-hydrocarbon gases.

28 Claims, No Drawings

METHOD FOR SEPARATION OF NON-HYDROCARBON GASES FROM HYDROCARBON GASES

This application is a 371 of PCT application No. PCT/AU01/01637, filed on Dec. 19, 2001.

FIELD OF THE INVENTION

The present invention relates to a method for separation of hydrocarbon gases from non-hydrocarbon gases. It is anticipated that the method of the present invention will have particular utility in separating non-hydrocarbon contaminants from natural gas.

BACKGROUND ART

Many natural sources of hydrocarbons contain high percentages of non-hydrocarbon components, such as nitrogen, carbon dioxide, helium and hydrogen sulphide. Also however, techniques for the production of synthetic natural gas typically result in methane contaminated with hydrogen and carbon monoxide. For most applications to which the hydrocarbons will ultimately be put, it is desirable to remove these non-hydrocarbon contaminants.

Further, for simple hydrates, carbon dioxide forms a structure I hydrate, whilst nitrogen preferentially forms a structure II hydrate. However, the structure of the hydrate formed by a mixture of nitrogen and carbon dioxide may be either structure I or structure II, depending on the composition of the mixture and the pressure at which the hydrate was formed.

Despite this complexity, the separation of compounds based on their differing tendency to form hydrates has been proposed. For example, in U.S. Pat. No. 5,434,330, Hnatow and Happel describe a process and apparatus for controlling the formation and decomposition of gas hydrates to improve separation rates. The method described therein involves contacting a mixture of gases with an pre-cooled aqueous medium to form a suspension of solid hydrate therein. The pre-cooled aqueous medium contains high concentrations of methanol, intended to enable the aqueous medium to be cooled to lower temperatures without freezing.

The methanol is also used as a separating agent based on the differing solubilities of the gases of the mixture therein.

However, the process described in U.S. Pat. No. 5,434,330 requires elevated pressures, and low temperatures to produce the hydrate, adding considerably to the expense of the process.

It is an object of this invention to provide an alternative method for the separation of non-hydrocarbon gases from hydrocarbon gases.

The preceding discussion of the background to the invention is intended to facilitate an understanding of the present invention only. It should be appreciated that the discussion is not an acknowledgement or admission that any of the material referred to was part of the common general knowledge in Australia as at the priority date of the application.

Throughout the specification, unless the context requires otherwise, the word "comprise" or variations such as "comprises" or "comprising", will be understood to imply the inclusion of a stated integer or group of integers but not the exclusion of any other integer or group of integers.

DISCLOSURE OF THE INVENTION

In accordance with the present invention, there is provided a method for the separation of non-hydrocarbon gases from hydrocarbon gases, the method comprising the steps of:

adding water and an agent adapted to reduce the interfacial tension between water and hydrocarbons to a first stream of desired hydrocarbon and undesired non-hydrocarbon gases to form a gas-agent-water mixture;

pressurising the gas-agent-water mixture; and cooling the gas-water-agent mixture to initiate the formation of a hydrate richer in desired hydrocarbons and leaner in undesired non-hydrocarbons relative to the first stream of desired hydrocarbon and undesired non-hydrocarbon gases.

It has been found that the agent adapted to reduce the interfacial tension between water and hydrocarbons substantially affects the tendencies of the desired hydrocarbons and the undesired non-hydrocarbons to form hydrates, and the qualities of the hydrate formed, enabling more efficient separation of the desired hydrocarbons from the undesired non-hydrocarbons than is possible using conventional hydrates.

More specifically, and without wishing to be bound by theory, the agent adapted to reduce the interfacial tension between water and hydrocarbons allows the hydrate to be formed at a substantially higher temperature, well in excess of the temperature at which non-hydrocarbon components, such as nitrogen and carbon dioxide form hydrates. Hence, the hydrate so formed is richer in hydrocarbon components and leaner in non-hydrocarbon components that the gas from which it was formed.

In one form of the invention, the method comprises the preliminary step of:

adding the agent adapted to reduce the interfacial tension between water and hydrocarbons to the water to form an agent-water mixture before adding the agent-water mixture to the first stream of desired hydrocarbon and undesired non-hydrocarbon gases to form a gas-agent water mixture.

Preferably, after the step of rapidly depressurising the gas-water-agent mixture to initiate the formation of the a hydrate richer in desired hydrocarbons and leaner in undesired non-hydrocarbons, the method comprises the additional step of decomposing the hydrate so formed to produce a second stream rich in desired hydrocarbons and lean in undesired hydrocarbons, relative to the first stream.

Further, as the hydrate produced is stable at higher temperatures, when the hydrate decomposes, the desired hydrocarbons are released at an appreciably slower rate than the undesired non-hydrocarbons.

Accordingly, the method of the present invention may more specifically comprise the step of:

controlling the decomposition of the hydrate so formed to produce a second stream rich in desired hydrocarbons and lean in undesired hydrocarbons, relative to the first stream, and the hydrate.

Where the method of the present invention comprises the step of decomposing the hydrate so formed to produce a second stream rich in desired hydrocarbons and lean in undesired hydrocarbons, relative to the first stream, the method of the present invention may also comprise the additional steps of:

adding water and an agent adapted to reduce the interfacial tension between water and hydrocarbons to the second stream to form a further gas-agent-water mixture;

pressurising the further gas-agent-water mixture; and rapidly cooling the further gas-water-agent mixture to initiate the formation of a further hydrate rich in desired hydrocarbons and lean in undesired non-hydrocarbons.

Preferably, the method comprises the additional step of decomposing the further hydrate so formed to produce a third stream rich in desired hydrocarbons and lean in undesired hydrocarbons, relative to the second stream.

The method of the present invention may more specifically comprise the step of:

controlling the decomposition of the hydrate so formed to produce a third stream rich in desired hydrocarbons and lean in undesired hydrocarbons, relative to the second stream, and the hydrate.

It is desirable that the gas-water-agent mixture be subdivided as it is rapidly cooled. Preferably, the gas-water-agent mixture is atomised as it is rapidly cooled.

Preferably, the gas-water-agent mixture is rapidly cooled to a temperature of between about −15 and −20° C. In a specific form of the invention, the gas-water-agent mixture is rapidly cooled to a temperature of approximately −18° C.

In one form of the invention, the gas-water-agent is at least partially cooled by way of rapid pressure reduction.

Preferably, the gas-water-agent mixture and/or the further gas-water-agent mixture are pressurised to between 1300 and 2500 psia. In one form of the invention, the gas-water-agent mixture and/or the further gas-water-agent mixture are pressurised to between 1300 and 2000 psia. In a further form of the invention, the gas-water-agent mixture and/or the further gas-water-agent mixture are pressurised to between 1300 and 1500 psia.

It has been found that higher pressures result in the formation of a hydrate richer in the desired hydrocarbon components relative to the undesired non-hydrocarbon components. However, the cost involved in increasing the pressure of the gas-water-agent mixture is significant, and the above pressures represent a compromise between optimal separation and cost considerations.

Where the gas-water-agent mixture is at least partially cooled by way of rapid pressure reduction, the gas-water-agent mixture may be introduced into a vessel having a pressure of approximately 100 psia. Preferably, the pressure of approximately 100 psia is maintained using methane.

Without wishing to be bound by theory, it is believed that the methane pressure provides temperature conductivity for the hydrate and/or the further hydrate so formed.

In one form of the invention, the agent is p-toluene sulfonic acid. Where the present invention is being applied to the separation of nitrogen from hydrocarbons, the agent is preferably p-toluene sulfonic acid or oleyl alcohol.

In alternate forms of the invention, the agent may be selected from the following: sodium lauryl sulphate, olelyl alcohol and di-isopropyl ether.

The agent is preferably present at a concentration corresponding to between 0.1 and 1.0% by weight relative to the water. In a highly specific form of the invention, the agent is present at a concentration corresponding to 0.3% by weight relative to the water.

It has been found that the addition of a particular concentration of additive substantially decreases the pressure that is required to form the hydrate at a given temperature. Accordingly, utilising said concentration at a particular pressure results in the formation of a hydrate richer in both the desired hydrocarbon components and the undesired non-hydrocarbon components relative to a hydrate formed using additives at other concentrations.

As noted above, it has been found that the agent adapted to reduce the interfacial tension between water and hydrocarbons substantially affect the qualities of the hydrate formed, enabling more efficient separation of the desired hydrocarbons from the undesired non-hydrocarbons than is possible using conventional hydrates. One of the qualities so affected is the hydrocarbon content of the hydrate formed.

In one form of the invention, the hydrate and/or further hydrate has a hydrocarbon content of in excess of 180 standard cubic metres of hydrocarbon gas per cubic metre of hydrate. In a preferred form of the invention, the hydrate and/or further hydrate has a hydrocarbon content of in excess of 186 standard cubic metres of hydrocarbon gas per cubic metre of hydrate. In a preferred form of the invention, the hydrate and/or further hydrate has a hydrocarbon content of in excess of 220 standard cubic metres of hydrocarbon gas per cubic metre of hydrate. In a preferred form of the invention, the hydrate and/or further hydrate has a hydrocarbon content of in excess of 229 standard cubic metres of hydrocarbon gas per cubic metre of hydrate.

BEST MODE(S) FOR CARRYING OUT THE INVENTION

The best mode for performing the present invention will now be described in the context of the separation of nitrogen from natural gas. However, the scope of the present invention should not be construed as being limited thereto.

An agent adapted to reduce the interfacial tension between water and hydrocarbons, in the form of p-toluenesulfonic acid, is added to water to a concentration of 0.3 mol %, to form an agent-water mixture. The agent-water mixture is in turn added to a first gaseous mixture of hydrocarbons, in the form of methane and ethane, and non-hydrocarbon gases, such as nitrogen, to form a gas-agent water mixture.

The gas-agent-water mixture is then pressurised to between 1300 and 2500 psia, and preferably to between 1300 and 1500 psia. The gas-water-agent mixture is then rapidly cooled to a temperature of between −15 and −20° C. and preferably to approximately −18° C., at least in part by way of a rapid pressure reduction, to initiate the formation of a hydrate rich in methane and ethane, having a hydrocarbon content of in excess of 180 standard cubic metres of hydrocarbon gas per cubic metre of hydrate, and lean in nitrogen, relative to the first gaseous mixture. The hydrate is also rich in ethane and lean in methane relative to the first gaseous mixture.

The pressure of the gas-water-agent mixture is reduced by atomising such into a reactor containing low-temperature methane at a pressure of approximately 100 psia, thereby providing temperature conductivity for the newly formed hydrate.

The hydrate is then decomposed to produce a second gaseous mixture rich in ethane and methane and lean in nitrogen, relative to the first gaseous mixture. Optionally, decomposition of the hydrate may be controlled by controlling the temperature thereof, such that the second gaseous mixture is also rich in ethane and methane and lean in nitrogen relative to the hydrate. If fractionation of the hydrocarbon components is required, the decomposition of the hydrate may be controlled by controlling the temperature thereof, such that a second gaseous mixture rich in ethane is produced first, and a second gaseous mixture rich in methane thereafter.

If further separation is required, an agent adapted to reduce the interfacial tension between water and hydrocarbons, in the form of p-toluenesulfonic acid, is added to water to a concentration of between 0.1 and 1.0 mol %, to form an agent-water mixture. The agent-water mixture may then be added to the or each second gaseous mixture to form a gas-agent water mixture. The or each gas-agent-water mixture is then pressurised to between 1300 and 2500 psia, and preferably to between 1300 and 1500 psia. The or each gas-water-agent mixture is then rapidly cooled to a temperature of between −15 and −20° C. and preferably to approximately −18° C., at least in part by way of a rapid pressure reduction, to initiate the formation of a further hydrate, having a hydrocarbon content of in excess of 180 standard cubic metres of hydrocarbon gas per cubic metre of hydrate, and lean in undesired non-hydrocarbons.

The pressure of the gas-water-agent mixture is reduced by atomising such into a reactor containing low-temperature methane at a pressure of approximately 100 psia, thereby providing temperature conductivity for the newly formed further hydrate.

The or each further hydrate is then decomposed to produce one or more third gaseous mixtures.

EXAMPLES

The method of the present invention will be described with reference to the following examples. However, it must be appreciated that the following description of those examples is not to limit the generality of the above description of the invention.

Examples 1 to 6

Separation of Nitrogen from Domestic Natural Gas Using P-Toluenesulfonic Acid

One litre of water was mixed with p-toluenesulfonic acid such that the p-toluenesulfonic acid comprised some 0.3% by weight of the mixture. A sample of domestic natural gas (180 cc at a predetermined pressure), having a composition as shown in Table 1 was combined with the water/p-toluenesulfonic acid mixture. The mixture was then cooled to −15° C., partly by rapid depressurisation through a Joule-Thompson valve into a cooled collection vessel, to form a gas hydrate. Unreacted gas was evacuated from the chamber and its composition measured by gas chromatography. The temperature of the chamber was then allowed to rise, causing decomposition of the hydrate. The composition of the mixture of gases generated by decomposition of the hydrate was then measured by gas chromatography.

Experiments were performed with the initial pressure of the gas-water-additive mixture at 500 psia, 1000 psia, 1500 psia, 2000 psia, 2500 psia and 3000 psia, corresponding to examples 1 through 6. Table 2, below, summarises the compositions of the unreacted gases formed in examples 1 through 6, whilst Table 3 summarises the compositions of the hydrate.

TABLE 1

| Component | Mol % |
|---|---|
| $CO_2$ | 2.20 |
| $N_2$ | 2.59 |
| Hydrocarbon | 95.21 |

TABLE 2

| | Mol % | | | | | |
|---|---|---|---|---|---|---|
| Component | 3000 psia | 2500 psia | 2000 psia | 1500 psia | 1000 psia | 500 psia |
| $N_2$ | 1.52 | 2.72 | 2.70 | 2.90 | 3.44 | 3.44 |
| Hydrocarbon | 9.53 | 10.03 | 10.29 | 10.66 | 11.14 | 11.40 |

TABLE 3

| | Mol % | | | | | |
|---|---|---|---|---|---|---|
| Component | 3000 psia | 2500 psia | 2000 psia | 1500 psia | 1000 psia | 500 psia |
| $N_2$ | 1.50 | 1.03 | 0.99 | 0.91 | 0.80 | 0.58 |
| Hydrocarbon | 32.45 | 28.68 | 28.58 | 26.80 | 25.54 | 23.16 |

As can be seen from Tables 1 to 3, the nitrogen content of the excess gas is substantially increased relative to the hydrate.

Examples 13–18

Separation of Nitrogen from Domestic Natural Gas Using Para-Toluene Sulphonic Acid (TSA)

One litre of water was mixed with TSA such that the TSA comprised some 0.3% by weight of the mixture. A sample of domestic natural gas (180 cc at a predetermined pressure), having a composition as shown in Table 1, above, was combined with the water/TSA mixture and the resulting mixture pressurised to a predetermined pressure. The mixture was then cooled to −15° C., partly by rapid depressurisation through a Joule-Thompson valve into a cooled collection vessel, to form a gas hydrate. Unreacted gas was evacuated from the chamber and its composition measured by gas chromatography. The temperature of the chamber was then allowed to rise, causing decomposition of the hydrate. The composition of the mixture of gases generated by decomposition of the hydrate was then measured by gas chromatography.

Experiments were performed with the initial pressure of the gas-water-additive mixture at 500 psia, 1000 psia, 1500 psia, 2000 psia, 2500 psia and 3000 psia, corresponding to examples 7 through 12. Table 6, below, summarises the compositions of the unreacted gases formed in examples 13 through 18, whilst Table 7 summarises the compositions of the hydrate.

TABLE 6

| | Mol % | | | | | |
|---|---|---|---|---|---|---|
| Component | 3000 psia | 2500 psia | 2000 psia | 1500 psia | 1000 psia | 500 psia |
| $N_2$ | 1.52 | 2.72 | 2.7 | 2.9 | 3.44 | 3.44 |
| Hydrocarbon | 9.53 | 10.03 | 10.29 | 10.66 | 11.14 | 11.4 |

TABLE 7

| | Mol % | | | | | |
|---|---|---|---|---|---|---|
| Component | 3000 psia | 2500 psia | 2000 psia | 1500 psia | 1000 psia | 500 psia |
| $N_2$ | 1.52 | 1.03 | 0.99 | 0.91 | 0.8 | 0.58 |
| Hydrocarbon | 32.45 | 28.68 | 28.58 | 26.8 | 25.54 | 22.58 |

Examples 19–21

Hydrates used in Examples 19–20 were formed by adding water and TSA (0.1% by volume) were introduced into a sapphire cell. The cell was pressurised with methane gas above the hydrate equilibrium pressure for a normal water-methane system. Equilibrium was achieved quickly by bubbling the methane through the water phase. The system was stabilised at a pressure of (1000 psia) and room temperature of about 23° C. The hydrate used in Example 21 was formed by a method in which the pressure was stabilised at 800 psia.

The temperature was then reduced using a thermostat air bath to −15 C. for Example 21, −18 C. for Example 20 and −20 C. for Example 19. Crystals of methane hydrate were observed on the sapphire window, and hydrate formation was assumed to be complete when pressure had stabilised in the cell. The purge gas and the gas generated by decomposition of the hydrates were analysed by gas chromatography and the results are summarised in Table 8, below.

TABLE 8

| Sample | Example 19 | | Example 20 | | Example 21 | |
|---|---|---|---|---|---|---|
| Type | Purge | Hydrate | Purge | Hydrate | Purge | Hydrate |
| Component | Mol % | | | | | |
| CO2 | 2.78 | 3.15 | 2.16 | 16.42 | 4.78 | 11.3 |
| Nitrogen | 48.69 | 30.19 | 52.40 | 21.74 | 2.48 | 0.53 |
| Hydrocarbons | 48.53 | 66.66 | 45.44 | 61.84 | 92.74 | 88.17 |
| Totals | 100 | 100 | 100 | 100 | 100 | 100 |
| Critical Pressure (psia) | 592.60 | 626.60 | 683.90 | 584.00 | 683.2 | 705.3 |
| Critical Temperature (R) | 304.6 | 330.70 | 393.50 | 286.80 | 361.3 | 387.9 |
| Calculated Gas Gravity | 0.82 | 0.76 | 0.96 | 0.82 | 0.637 | 0.750 |
| Average Molecular Weight | 23.67 | 21.86 | 27.77 | 23.73 | 18.46 | 21.73 |

Again, the amount of nitrogen present in the hydrate is substantially lower than that found in the gas purge, as the nitrogen does not form hydrate readily at the elevated temperatures. In Example 19, the nitrogen content was near 50 mol % in the purge gas, while only 30 mol % in the hydrate. The methane content went from 44–61% between the purge gas and the hydrate. Example 20 showed 50 mol % nitrogen in the purge gas, while only 20% in the hydrate.

For Examples 19 and 20, the amount of nitrogen in the hydrate was relatively high due to the low temperatures. As stated above, Example 21 was conducted only at 800 psia, and the difference in the concentration between the hydrate and the purge gas was large.

International Patent Application PCT/AU00/00719, titled 'Natural Gas Hydrate and Method for Producing Same' contains several examples demonstrating that the temperature at which gas hydrates are formed is increased by the inclusion of an agent adapted to reduce the interfacial tension between water and hydrocarbons, and the contents of this specification are hereby incorporated by reference.

Modifications and variations such as would be apparent to the skilled addressee are considered to fall within the scope of this application.

What is claimed is:

1. A method for the separation of non-hydrocarbon gases from hydrocarbon gases, the method comprising the steps of:

adding water and an agent adapted to reduce the interfacial tension between water and hydrocarbons to a first stream of desired hydrocarbon and undesired non-hydrocarbon gases to form a gas-agent-water mixture;

pressurising the gas-agent-water mixture, and rapidly cooling the gas-water-agent to initiate the formation of a hydrate richer in desired hydrocarbons and leaner in undesired non-hydrocarbons relative to the first stream of desired hydrocarbon and undesired non-hydrocarbon gases.

2. The method of claim 1, further comprising the step of:

adding the agent adapted to reduce the interfacial tension between water and hydrocarbons to the water to form an agent-water mixture before adding the agent-water mixture to the first stream of desired hydrocarbon and undesired non-hydrocarbon gases to form a gas-agent-water mixture.

3. The method of claim 1, further comprising the step of:

after the step of rapidly cooling the gas-water-agent mixture to initiate the formation of the hydrate richer in desired hydrocarbons and leaner in undesired non-hydrocarbons, decomposing the hydrate so formed to produce a second stream rich in desired hydrocarbons and lean in undesired hydrocarbons, relative to the first stream.

4. The method of claim 3, further comprising the step of:

controlling the decomposition of the hydrate so formed to produce a second stream rich in desired hydrocarbons and lean in undesired hydrocarbons, relative to the first stream, and the hydrate.

5. The method of claim 3, further comprising the steps of:

adding water and an agent adapted to reduce the interfacial tension between water and hydrocarbons to the second stream to form a further gas-agent-water mixture;

pressurising the further gas-agent-water mixture; and rapidly cooling the further gas-water-agent mixture to initiate the formation of a further hydrate rich in desired hydrocarbons and lean in undesired non-hydrocarbons.

6. The method of claim 5, further comprising the step of:

decomposing the further hydrate so formed to produce a third stream rich in desired hydrocarbons and lean in undesired hydrocarbons, relative to the second stream.

7. The method of claim 6, further comprising the step of:

controlling the decomposition of the hydrate so formed to produce a third stream rich in desired hydrocarbons and lean in undesired hydrocarbons, relative to the second stream, and the hydrate.

8. The method of claim 1, wherein the gas-water-agent mixture is sub-divided as it is rapidly cooled.

9. The method of claim 1, wherein the gas-water-agent mixture is atomised as it is rapidly cooled.

10. The method of claim 5, wherein the gas-water-agent mixture and/or the further gas-water-agent mixture are rapidly cooled to a temperature of between about −15° C. and −20° C.

11. The method of claim 10, wherein the gas-water-agent mixture is rapidly cooled to a temperature of approximately −18° C.

12. The method of claim 5, wherein the gas-water-agent and/or the further gas-water-agent mixture are at least partially cooled by way of rapid pressure reduction.

13. The method of claim 5, wherein the gas-water-agent mixture and/or the further gas-water-agent mixture are pressurised to between 1300 and 2500 psia.

14. The method of claim 13, wherein the gas-water-agent mixture and/or the further gas-water-agent mixture are pressurised to between 1300 and 2000 psia.

15. The method of claim 14, wherein the gas-water-agent mixture and/or the further gas-water-agent mixture are pressurised to between 1300 and 1500 psia.

16. The method of claim 5, wherein the gas-water-agent mixture and/or the further gas-water-agent mixture are at least partially cooled by way of rapid pressure reduction characterised in that the gas-water-agent mixture and/or the further gas-water-agent mixture are introduced into a vessel having a pressure of approximately 100 psia.

17. The method of claim 16, wherein the pressure of approximately 100 psia is maintained using methane.

18. The method of claim 5, wherein the agent is selected from the group consisting of sodium lauryl sulphate, olelyl alcohol, di-isopropyl ether and p-toluene sulfonic acid.

19. The method of claim 18, wherein the agent is p-toluene sulfonic acid.

20. The method of claim 5, wherein the agent is present at a concentration corresponding to between 0.1 and 1.0% by weight relative to the water.

21. The method of claim 1, wherein the agent is present at a concentration corresponding to 0.3% by weight relative to the water.

22. The method of claim 5, wherein the hydrate and/or further hydrate has a hydrocarbon content of in excess of 180 standard cubic meters of hydrocarbon gas per cubic meter of hydrate.

23. The method of claim 22, wherein the hydrate and/or further hydrate has a hydrocarbon content of in excess of 186 standard cubic meters of hydrocarbon gas per cubic meter of hydrate.

24. The method of claim 23, wherein the hydrate and/or further hydrate has a hydrocarbon content of in excess of 220 standard cubic meters of hydrocarbon gas per cubic meter of hydrate.

25. The method of claim 24, wherein the hydrate and/or further hydrate has a hydrocarbon content of in excess of 229 standard cubic meters of hydrocarbon gas per cubic meter of hydrate.

26. The method of claim 5, wherein the step of pressurising the gas-water-agent mixture and/or the further gas-water-agent mixture is conducted at a pressure above the hydrated equilibrium pressure of a system comprising water and gas without the agent adapted to reduce interfacial tension.

27. The method of claim 26, further comprising the step of:

allowing the gas-water-agent mixture and/or the further gas-water-agent mixture to achieve equilibrium during the step of pressuring the gas-water-agent mixture and/or the further gas-water-agent mixture and prior to the step of rapidly cooling the gas-water-agent mixture and/or the further gas-water-agent mixture.

28. The method of claim 27, wherein the step of allowing the gas-water-agent mixture and/or the further gas-water-agent mixture to achieve equilibrium is conducted at room temperature.

* * * * *